US006686135B2

(12) United States Patent
Schwartz et al.

(10) Patent No.: US 6,686,135 B2
(45) Date of Patent: Feb. 3, 2004

(54) STABILIZED BLACK-AND-WHITE DEVELOPING COMPOSITIONS AND METHODS OF USE

(75) Inventors: Paul A. Schwartz, Webster, NY (US); Susan M. Flavin, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/376,183

(22) Filed: Feb. 26, 2003

(65) Prior Publication Data

US 2003/0162136 A1 Aug. 28, 2003

Related U.S. Application Data

(62) Division of application No. 10/000,893, filed on Nov. 2, 2001, now abandoned.

(51) Int. Cl.[7] ..... G03C 5/30
(52) U.S. Cl. ..... 430/493
(58) Field of Search ..... 430/493

(56) References Cited

U.S. PATENT DOCUMENTS

| | | | | |
|---|---|---|---|---|
| 4,126,461 A | | 11/1978 | Pupo et al. | 430/402 |
| 4,202,698 A | | 5/1980 | Jan et al. | 430/418 |
| 5,236,816 A | | 8/1993 | Purol et al. | 430/492 |
| 5,702,875 A | | 12/1997 | Opitz et al. | 430/492 |
| 5,756,271 A | * | 5/1998 | Opitz et al. | 430/465 |
| 5,766,832 A | | 6/1998 | Nishio | 430/465 |
| 5,824,458 A | | 10/1998 | Okutsu et al. | 430/490 |
| 5,851,742 A | | 12/1998 | Nishio | 430/465 |
| 6,077,651 A | | 6/2000 | Darmon et al. | 430/466 |

FOREIGN PATENT DOCUMENTS

| | | |
|---|---|---|
| EP | 0 603 586 A1 | 6/1994 |
| EP | 0 774 687 A1 | 5/1997 |
| EP | 0 777 150 A1 | 6/1997 |

OTHER PUBLICATIONS

JP Abstract 2000–292890 (Fuji).

* cited by examiner

*Primary Examiner*—Hoa Van Le
(74) *Attorney, Agent, or Firm*—J. Lanny Tucker

(57) ABSTRACT

A black-and-white photographic developing composition or developing kit includes an ascorbic acid developing agent and is essentially free of hydroquinone and similar developing agents. The developing composition further includes a water-miscible hydroxy-containing organic solvent having a molecular weight of from about 50 to about 200. The weight ratio of the organic solvent to water is from about 0.1:1 to about 8:1.

8 Claims, No Drawings

STABILIZED BLACK-AND-WHITE DEVELOPING COMPOSITIONS AND METHODS OF USE

CROSS-REFERENCE TO RELATED APPLICATION

This is a Divisional of application 10/000,893 filed Nov. 2, 2001, now abandoned.

FIELD OF THE INVENTION

This invention relates in general to photography and in particular to improved black-and-white developing compositions that can be provided in a single-part format. More particularly, it relates to improved and stabilized ascorbic acid black-and-white developing compositions and to methods for their use in processing photographic silver halide materials.

BACKGROUND OF THE INVENTION

Photographic black-and-white developing compositions containing a silver halide black-and-white developing agent are well known in the photographic art for reducing silver halide grains containing a latent image to yield a developed photographic image. Many useful developing agents are known in the art Hydroquinone and similar dihydroxybenzene compounds and ascorbic acid (and derivatives) are the most common. Such compositions generally contain other components such as sulfites, buffers, antifoggants, halides and hardeners.

Dihydroxybenzenes (such as hydroquinone) are the most common black-and-white developing agents and are quite active to provide development in various black-and-white photographic elements with or without booster and nucleating compounds. However, they are disadvantageous from several technical and environmental considerations. For example, hydroquinone compositions are not completely stable in air, being prone to aerial oxidation. The by-products from instability are often insoluble, black and tarry materials that contaminate the processing solutions and equipment.

The oxidation of hydroquinones also leads to higher pH that in turn leads to increased developer activity. Images can be produced faster so the processing time must be reduced. The net effect is less control of the process, and less desirable sensitometric properties in the processed materials.

In addition, bydroquinones have become an increasing concern from the point of view of potential toxicity and environmental pollution.

Another class of black-and-white developing agents are known in many publications as ascorbic acid and its various derivatives, for example as described in U.S. Pat. No. 5,236,816 (Purol et al.). While these types of developing agents are considerably more suitable to the environment, a major concern with ascorbic acid type developing agents is their stability to aerial oxidation.

U.S. Pat. No. 5,702,875 (Opitz et al.) describes weakly alkaline (pH 7 to 9) ascorbic acid developing compositions for processing black-and-white photographic materials. The developing composition is highly successful in the industry in two-part dry or liquid form. The two-part dry form is particularly preferred but there are opportunities to improve its stability and powdered consistency.

There is a need however for more stable ascorbic acid developing compositions for processing photographic silver halide materials that require a black-and-white developing step. It would be highly desirable to have such developing compositions in a single-part so mixing of multiple solutions or powders is avoided.

SUMMARY OF THE INVENTION

The invention provides an aqueous black-and-white photographic developing composition that is essentially free of dihydroxybenzene compounds and comprises:

a) an ascorbic acid developing agent, and b) a water-miscible hydroxy-containing organic solvent having a molecular weight of from about 50 to about 200, the weight ratio of the organic solvent to water being from about 0.1:1 to about 8:1.

In a preferred embodiment, the present invention provides a single-part, aqueous, black-and-white photographic developing composition having a pH of from about 8 to about 11 and that is essentially free of dihydroxybenzene compounds and comprises:

a) from about 0.1 to about 0.5 mol/l of an ascorbic acid developing agent, b) a water-miscible hydroxy-containing organic solvent having a molecular weight of from about 50 to about 200, the weight ratio of the organic solvent to water being from about 0.1:1 to about 1:1, c) from about 0.001 to about 0.2 mol/l of sulfite ions, d) from about 0.0005 to about 0.01 mol/l of a 3-pyrazolidone co-developing agent, and e) either or both of an organic antifoggant and metal ion sequestering agent.

In addition, the present invention provides a two-part aqueous black-and-white developing composition kit comprising:

a) an aqueous first solution having a pH of from about 3 to about 6 that is essentially free of dihydroxybenzene compounds and comprises:

at least 0.05 mol/l of an ascorbic acid developing agent, a water-miscible hydroxy-containing organic solvent having a molecular weight of from about 50 to about 200, the weight ratio of the organic solvent to water being from about 0.05:1 to about 8:1, and at least 0.0005 mol/l of a 3-pyrazolidone co-developing agent, and b) a second aqueous solution having a pH of from about 8 to about 12 and comprising a borate buffer and at least 0.05 mol/l of sulfite ions.

Further, the present invention provides a method of providing an image comprising contacting an imagewise exposed silver halide photographic material with the black-and-white photographic developing composition described above for at least 10 seconds.

In addition, a method of this invention provides an image comprising contacting an imagewise exposed silver halide photographic material with a black-and-white photographic developing composition formed by mixing the first and second solutions of the black-and-white developing composition kit described above for at least 10 seconds.

The present invention provides a stabilized black-and-white developing composition (single-part of two-part) by the use of a specific water-miscible hydroxy-containing organic solvents in the aqueous composition containing the ascorbic acid. This composition is substantially free of dihydroxybenzene compounds such as hydroquinone and its derivatives.

The improved stability (that is, reduced aerial oxidation) would generally reduce composition color change, loss in developing agent concentrations, and the formation of precipitates. Thus, shelf-life stability of the compositions is improved. Additionally there is improved pH stability of these compositions and we have noted less evaporation in compositions containing the water-miscible hydroxy-containing organic solvents.

DETAILED DESCRIPTION OF THE INVENTION

The present invention is useful for black-and-white development in any photographic silver halide material requiring at least one black-and-white development step. Such types of silver halide materials include, but are not limited to, particularly, radiographic films, aerial films, black-and-white motion picture films, duplicating and copy films, graphic arts films, positive- and negative-working microfilms, and amateur and professional continuous tone black-and-white films. The general constructions of such materials are well known in the art but specific features that render them particularly adaptable to the present invention are described below in more detail.

In addition, the black-and-white developing composition of this invention can be used in the "first" (black-and-white) development step(s) to obtain color images in color reversal photographic silver halide materials (details described below).

The black-and-white photographic developing compositions of this invention contain one or more ascorbic acid developing agents as a first essential component. An "ascorbic acid" developing agent means ascorbic acid and derivatives thereof. Ascorbic acid developing agents are described in a considerable number of publications regarding photographic processing. Useful ascorbic acid developing agents include ascorbic acid and the analogues, isomers and derivatives thereof Such compounds include, but are not limited to, D-, L-, or D,L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP-A-0 585,792 (published Mar. 9, 1994), EP-A-0 573 700 (published Dec. 15, 1993), EP-A-0 588 408 (published Mar. 23, 1994), WO 95/00881 (published Jan. 5, 1995), U.S. Pat. No. 5,089,819 and U.S. Pat. No. 5,278,035 (both of Knapp), U.S. Pat. No. 5,384,232 (Bishop et al.), U.S. Pat. No. 5,376,510 (Parker et al.), Japanese Kokai 7-56286 (published Mar. 3, 1995), U.S. Pat. No. 2,688,549 (James et al.), U.S. Pat. No. 5,702,875 (noted above), U.S. Pat. No. 5,236,816 (noted above), and Research Disclosure, publication 37152, March 1995. Mixtures of these developing agents can be used if desired.

A second essential component of the black-and-white photographic developing compositions includes one or more water-miscible hydroxy-containing organic solvents. In the single-part composition, the organic solvent is present at a weight ratio of organic solvent to water of from about 0.1:1 to about 8:1, and in the two-part composition kit, the organic solvent is present in the first part at a weight ratio of organic solvent to water of from about 0.05:1 to about 8:1. Such organic solvents can be used singly or in combination, and generally each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They can be straight-chain molecules or cyclic molecules. The straight-chain solvents are preferred.

The organic solvents are "photographically inactive," meaning that they provide no substantial positive or negative effect upon the developing function of the composition of this invention.

Useful organic solvents include, but are not limited to, polyols including glycols (such as ethylene glycol, propylene glycol, diethylene glycol and triethylene glycol) and alcohols (such as ethanol and benzyl alcohol). Glycols are preferred with ethylene glycol, diethylene glycol, polyethylene glycol, and triethylene glycol being most preferred. Of the alcohols, ethanol and benzyl alcohol are preferred. The most preferred organic solvent is diethylene glycol.

The amounts of water and organic solvent in the composition of this invention are carefully controlled to achieve all of the desired results and to insure a single-phase homogeneous composition, especially when it is in a single-part format. If there is too much water, phase separation may occur. If there is too much organic solvent, the buffering agent and other salts will precipitate.

The black-and-white photographic developing composition can also include one or more auxiliary co-developing agents that are also well known (for example, Mason, *Photographic Processing Chemistry,* Focal Press, London, 1975). Any auxiliary developing agent can be used, but the 3-pyrazolidone developing agents are preferred (also known as "phenidone" type developing agents). Such compounds are described, for example, in U.S. Pat. No. 5,236,816 (noted above). The most commonly used compounds of this class are 1-phenyl-3-pyrazolidone, 1-phenyl-4,4-dimethyl-3-pyrazolidone, 4-hydroxymethyl-4-methyl-1-pheny 5-phenyl-3-pyrazolidone, 1-p-aminophenyl-4,4-dimethyl-3-pyrazolidone, 1-p-tolyl-4,4-dimethyl-3-pyrazolidone, 1-p-tolyl-4-hydroxymethyl-4-methyl-3-pyrazolidone, and 1-phenyl-4,4-dihydroxymethyl-3-pyrazolidone. Other useful auxiliary co-developing agents comprise one or more solubilizing groups, such as sulfo, carboxy or hydroxy groups attached to aliphatic chains or aromatic rings, and preferably attached to the hydroxymethyl function of a pyrazolidone, as described for example, in U.S. Pat. No. 5,837,434 (Roussilbe et al.). A most preferred auxiliary co-developing agent is 4-hydroxymethyl-4-methyl-1-phenyl-3-pyrazolidone (HMMP).

Less preferred auxiliary co-developing agents include aminophenols such as p-aminophenol, o-aminophenol, N-methylaminophenol, 2,4-diaminophenol hydrochloride, N-(4-hydroxyphenyl)glycine, p-benzylaminophenol hydrochloride, 2,4-diamino-6-methylphenol, 2,4-diaminoresorcinol and N-(β-hydroxyethyl)-p-aminophenol. A mixture of different types of auxiliary developing agents can also be used if desired.

An organic or inorganic antifoggant can also be present in the black-and-white photographic developing composition, either singly or in admixture. Such compounds control the gross fog appearance in the processed elements. Useful inorganic antifoggants include various halide salts including bromides. Suitable organic antifoggants include, but are not limited to, benzimidazoles, benzotriazoles, mercaptotetrazoles, indazoles and mercaptothiadiazoles. Representative antifoggants include 5-nitroindazole, 5-p-nitrobenzoyl-aminoimidazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole.

The composition of this invention can also include one or more preservatives or antioxidants. Both organic preservatives such as hydroxylamine and alkyl- and arylbydroxylamines and inorganic preservatives such as sulfites can be used. Sulfites are preferred. A "sulfite" preservative is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite, and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

Various known buffers, such as borates, carbonates and phosphates, or combinations of any of these can be included in the compositions to maintain the desired pH when in aqueous form. The pH can be adjusted with a suitable base (such as a hydroxide) or acid. In some embodiments, the pH of the developing composition of this invention (in aqueous form) is generally from about 8 to about 12, and more preferably from about 9 to about 11. In other embodiments, the pH can be acidic, for example from about 3 to about 6. The buffers can be the same or different when tvo-part composition kits are used.

Optionally, the black-and-white developing composition contains one or more sequestering agents that typically function to form stable complexes with free metal ions or trace impurities (such as silver, calcium, iron and copper ions) in solution that may be introduced into the developing composition in a number of ways. The sequestering agents, individually or in admixture, are present in conventional amounts, in conventional amounts. Many useful sequestering agents are known in the art, but particularly useful classes of compounds include, but are not limited to, multimeric carboxylic acids, polyphosphonic acids and polyaminophosphonic acids, and any combinations of these classes of materials as described in U.S. Pat. No. 5,389,502 (Fitterman et al.), aminopolycarboxylic acids, polyphosphate ligands and alkanolamines. Representative sequestering agents include ethylenediaminetetraacetic acid, diethylenetriaminepentaacetic acid, 1,3-propylenediaminetetraacetic acid, 1,3-diamino-2-propanoltetraacetic acid, ethylenediaminodisuccinic acid, ethylenediaminomonosuccinic acid, 4,5-dihydroxy-1,3-benzenedisulfonic acid, disodium salt (TIRON™), N,N'-1,2-ethanediylbis {N-[(2-hydroxyphenyl)-methyl]} glycine ("HBED"), N-{2-[bis(carboxymethyl)amino]ethyl}-N-(2-hydroxyethyl)glycine ("HEDTA"), N-{2-[bis(carboxymethyl)amino]ethyl}-N-(2-hydroxyethyl)glycine, trisodium salt (available as VERSENOL™ from Acros Organics, Sigma Chemical or Callaway Chemical), and 1-hydroxyethylidenediphosphonic acid (available as DEQUEST™ 2010 from Solutia Co.).

The black-and-white photographic developing composition can also contain other additives including various development restrainers, development accelerators, swelling control agents, or trace impurities (such as silver, calcium, iron and copper ions) in solution that may be introduced into the composition in a number of ways. The sequestering agents, individually or in admixture, are present in conventional amounts. Examples of such optional components are described in U.S. Pat. No. 5,236,816 (noted above), U.S. Pat. No. 5,474,879 (Fitterman et al.), U.S. Pat. No. 5,837,434 (Roussilhe et al.), U.S. Pat. No. 5,702,875 (noted above), Japanese Kokai 7-56286, and EP-A-0 585 792.

The photographic developing compositions of this invention are essentially free of dihydroxybenzene compounds (such as hydroquinone). By "essentially free" is meant that such compounds are not purposely added and may be inadvertently present in an amount of less than 0.0001 mol/l.

The essential (and some optional) components described above are present in the aqueous developing compositions in the general and preferred amounts listed in TABLES I and II, all minimum and maximum amounts being approximate (that is, "about"). TABLE I shows the concentrations for a single-part composition and TABLE II shows the concentrations for the more common two-part composition kit of this invention.

TABLE I

| Single-Part Developing Composition | General Amount | Preferred Amount |
|---|---|---|
| Ascorbic acid developing agent | 0.05 to 1.0 mol/l | 0.1 to 0.5 mol/l |
| Auxiliary Co-developing agent | 0.0005 to 0.025 mol/l | 0.0005 to 0.01 mol/l |
| Preservative (e.g. sulfite ions) | 0 to 0.5 mol/l | 0.001 to 0.2 mol/l |
| Buffer | 0 to 0.5 mol/l | 0.01 to 0.2 mol/l |
| Organic solvent to water weight ratio | 0.1:1 to 8:1 | 0.1:1 to 1:1 |
| pH | 8 to 12 | 9 to 11 |

TABLE II

| | General Amount | Preferred Amount |
|---|---|---|
| First Solution | | |
| Ascorbic acid developing agent | 0.05 to 1.5 mol/l | 0.2 to 1.0 mol/l |
| Auxiliary Co-developing agent | 0.0005 to 0.05 mol/l | 0.0005 to 0.02 mol/l |
| Preservative (e.g. sulfite ions) | 0 to 0.5 mol/l | 0 to 0.2 mol/l |
| Buffer | 0 to 0.5 mol/l | 0 to 0.2 mol/l |
| Organic solvent to water weight ratio | 0.05:1 to 8:1 | 0.1:1 to 1:1 |
| pH | 3 to 6 | 4.5 to 5.5 |
| Second Solution | | |
| Preservative (e.g. sulfite ions) | 0.05 to 0.5 mol/l | 0.1 to 0.4 mol/l |
| Buffer (e.g. borate) | 0.05 to 0.5 mol/l | 0.1 to 0.4 mol/l |
| pH | 8 to 12 | 9 to 11 |

Thus, the photographic developing composition of this invention can be provided as a single-part aqueous solution in concentrated or diluted form. This composition can be made up and used right away or packaged in a suitable container for future use.

In addition, the photographic developing composition can be one solution of a two-part composition kit, and each solution in the kit can also be provided in concentrated or diluted form. Each solution can be made up and used right away or individually packaged for future use. In such embodiments, the first solution contains the two essential components, that is the ascorbic acid developing agent and the organic solvent. The second solution (second part) can include any other components or additives described herein that may be desired for black-and-white processing. Thus, the components for the first and second parts are not limited to those shown in TABLE II above. However, TABLE II shows the preferred components for the two-part composition kit of this invention.

In most processing methods in which the photographic developing composition of this invention is used, its use is generally followed by a fixing step using a photographic fixing composition containing a photographic fixing agent. While sulfite ion sometimes acts as a fixing agent, the fixing agents generally used are thiosulfates (including sodium thiosulfate, ammonium thiosulfate, potassium thiosulfate and others readily known in the art), cysteine (and similar thiol containing compounds), mercapto-substituted compounds (such as those described by Haist, *Modern Photographic Processing,* John Wiley & Sons, N.Y., 1979), thiocyanates (such as sodium thiocyanate, potassium thiocyanate, ammonium thiocyanate and others readily known in the art), amines or halides. Mixtures of one or more of these classes of photographic fixing agents can be used if desired. Thiosulfates and thiocyanates are preferred. In some embodiments, a mixture of a thiocyanate (such as sodium thiocyanate) and a thiosulfate (such as sodium thiosulfate) is used. In such mixtures, the molar ratio of a thiosulfate to a thiocyanate is from about 1:1 to about 1:10, and preferably from about 1:1 to about 1:2. The sodium salts of the fixing agents are preferred for environmental advantages.

The fixing composition can also include various addenda commonly employed therein, such as buffers, fixing accelerators, sequestering agents, swelling control agents, and stabilizing agents, each in conventional amounts. In its aqueous form, the fixing composition generally has a pH of at least 4, preferably at least 4.5, and generally less than 6, and preferably less than 5.5.

The photographic developing and fixing compositions useful in the practice of this invention are provided in aqueous form and can be in concentrated form and diluted to working strength just before use, or during use. Alternatively, the compositions can be provided at "working strength." The components of the developing composition can also be provided in a kit of two parts to be combined and diluted with water to the desired strength and placed in the processing equipment. The compositions can be used as their own replenishers, or another similar solutions can be used as the replenishers.

Processing can be carried out in any suitable processor or processing container for a given type of photographic element (for example, sheets, strips or rolls). The photographic material is generally bathed in the processing compositions for a suitable period of time.

In processing black-and-white photographic materials, development and fixing are preferably, but not essentially, followed by a suitable washing step to remove silver salts dissolved by fixing and excess fixing agents, and to reduce swelling in the element. The wash solution can be water, but preferably the wash solution is acidic, and more preferably, the pH is 7 or less, and preferably from about 4.5 to about 7, as provided by a suitable chemical acid or buffer.

After washing, the processed elements may be dried for suitable times and temperatures, but in some instances the black-and-white images may be viewed in a wet condition.

For example, exposure and processing of radiographic films can be undertaken in any convenient conventional manner. The exposure and processing techniques of U.S. Pat. Nos. 5,021,327 and 5,576,156 (both noted above) are typical for processing radiographic films. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al.) and EP-A-0 248,390 (Akio et al.).

The photographic developing composition of this invention can be used in both what are known as "slow access" and "rapid access" processing methods and equipment. For example, black-and-white motion picture films, industrial radiographic films and professional films and papers are generally developed over a longer period of time (for example, for at least 1 minute and up to 12 minutes). Total processing including other steps (for example fixing and washing) would be even longer.

"Rapid access" methods are generally used to process medical radiographic X-ray films, graphic arts films and microfilms and development may be at least 10 seconds and up to 60 seconds (preferably from about 10 to about 30 seconds). The total processing time (for example including fixing and washing) is as short as possible, but generally from about 20 to about 120 seconds. An example of a "rapid access" system is that commercially available as the KODAK RP X-OMAT™ processing system that also includes a conventional photographic fixing composition.

For either type of processing method, the development temperature can be any temperature within a wide range as known by one skilled in the art, for example from about 15 to about 60° C.

The black-and-white photographic silver halide materials processed using the present invention are generally composed of a conventional flexible, transparent film support (polyester, cellulose acetate or polycarbonate) that has applied to each side one or more photographic silver halide emulsion layers. For radiographic films, it is conventional to use blue-tinted support materials to contribute to the blue-black image tone sought in fully processed films. Polyethylene terephthalate and polyethylene naphthalate are preferred film supports.

In general, such materials, emulsions, and layer compositions are described in many publications, including *Research Disclosure,* publication 36544, September 1994. *Research Disclosure* is a publication of Kenneth Mason Publications, Ltd., Dudley House, 12 North Street, Emsworth, Hampshire PO10 7DQ England.

The support can take the form of any conventional element support. Useful supports can be chosen from among those described in *Research Disclosure,* September 1996, Item 38957 XV. Supports and *Research Disclosure,* Vol. 184, August 1979, Item 18431, XII. Film Supports. They can be transparent or translucent polymeric film supports, or opaque cellulosic papers. The support is preferably a transparent film support. In its simplest possible form the film support consists of a material chosen to allow direct adhesion of the hydrophilic silver halide emulsion layers or other hydrophilic layers. More commonly, the support is itself hydrophobic and subbing layers are coated thereon to facilitate adhesion of the hydrophilic silver halide emulsion layers.

The photographic materials include one or more silver halide emulsion layers that comprise one or more types of silver halide grains responsive to suitable electromagnetic radiation. Such emulsions include silver halide grains composed of, for example, silver bromide, silver iodobromide, silver chlorobromide, silver iodochlorobromide, and silver chloroiodobromide, or any combinations thereof The silver halide grains in each silver halide emulsion unit (or silver halide emulsion layers) can be the same or different, or mixtures of different types of grains.

The silver halide grains can have any desired morphology (for example, cubic, tabular, octahedral), or mixtures of grains of various morphologies. In some embodiments, at least 50% (and preferably at least 70%) of the silver halide grain projected area is provided by tabular grains having an average aspect ratio greater than 8, and preferably greater than 12.

Imaging contrast can be raised by the incorporation of one or more contrast enhancing dopants. Rhodium, cadmium, lead and bismuth are all well known to increase contrast by restraining toe development. Rhodium is most commonly employed to increase contrast and is specifically preferred.

A variety of other dopants are known individually and in combination, to improve contrast as well as other common properties, such as speed and reciprocity characteristics. Dopants capable providing "shallow electron trapping" sites commonly referred to as SET dopants are specifically contemplated. SET dopants are described in *Research Disclosure,* Vol. 367, Nov. 1994, Item 36736. Iridium dopants are very commonly employed to decrease reciprocity failure. A summary of conventional dopants to improve speed, reciprocity and other imaging characteristics is provided by *Research Disclosure,* Item 36544, cited above, Section 1. Emulsion grains and their preparation, subsection D. Grain modifying conditions and adjustments, paragraphs (3), (4) and (5).

Low COV emulsions can be selected from among those prepared by conventional batch double jet precipitation techniques. A general summary of silver halide emulsions and their preparation is provided by *Research Disclosure,* Item 36544, cited above, Section I. Emulsion grains and their preparation. After precipitation and before chemical sensitization the emulsions can be washed by any convenient conventional technique using techniques disclosed by *Research Disclosure,* Item 36544, cited above, Section III. Emulsion washing.

The emulsions can be chemically sensitized by any convenient conventional technique as illustrated by *Research Disclosure,* Item 36544, Section IV. Chemical sensitization. Sulfur and gold sensitization is specifically contemplated.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 36544, Section VII. Antifoggants and stabilizers, and Item 18431, Section II. Emulsion Stabilizers, Antifoggants and Antikinking Agents.

The silver halide emulsion and other layers forming the layers on the support contain conventional hydrophilic colloid vehicles (peptizers and binders) that are typically gelatin or a gelatin derivative (identified herein as "gelatino-vehicles"). Conventional gelatino-vehicles and related layer features are disclosed in *Research Disclosure,* Item 36544, Section II. Vehicles, vehicle extenders, vehicle-like addenda and vehicle related addenda. The emulsions themselves can contain peptizers of the type set out in Section II noted above, paragraph A. Gelatin and hydrophilic colloid peptizers. The hydrophilic colloid peptizers are also useful as binders and hence are commonly present in much higher concentrations than required to perform the peptizing function alone. The gelatino-vehicle extends also to materials that are not themselves useful as peptizers. The preferred gelatino-vehicles include alkali-treated gelatin, acid-treated gelatin or gelatin derivatives (such as acetylated gelatin and phthalated gelatin). Depending upon the use of the materials, the binder-containing layers can be hardened or unhardened.

Some photographic materials can include a surface overcoat on each side of the support that are typically provided for physical protection of the emulsion layers. In addition to vehicle features discussed above the overcoats can contain various addenda to modify the physical properties of the overcoats. Such addenda are illustrated by *Research Disclosure,* Item 36544, Section IX. Coating physical property modifying addenda, A. Coating Aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of surface overcoat addenda, such as anti-matte particles, in the interlayers.

Representative black-and-white films and papers that can be processed using the present invention include, but are not limited to, KODAK TRI-X-PAN Black and White Film, KODAK PLUS X-PAN Black and White Film, KODAK TMAX 100 and 400 speed Black and White Films, KODAK POLYMAX II RC Black and White Papers, KODAK KODABROME II RC F Black and White Paper, KODAK PMAX Art RC V Black and White Paper, KODAK POLY-CONTRAST III RC Black and White Paper, KODAK PANALURE Select RC Black and White Paper, KODAK POLYMAX FINE ART Black and White Papers, KODAK AZO Black and White Papers, ILFORD MULTIGRADE IV RC and FB Black and White Papers, ILFORD ILFOBROME GALARIE Black and White Papers, and AGFA MULTICONTRAST CLASSIC, PREMIUM Black and White Papers, various KODAK T-MAT Radiographic Films, various KODAK INSIGHT Radiographic Films, KODAK X-OMAT Duplicating Film, various KODAK EKTASCAN Radiographic Films, KODAK CFT, CFL, CFS and CFE Radiographic Films, KODAK EKTASPEED and EKTASPEED PLUS Dental Films and KODAK ULTRASPEED Dental Film.

The black-and-white photographic developing composition can also be used in the first development step to provide color positive images using color reversal photographic silver halide materials.

Such materials are usually processed using the following sequence of processing steps: first (or black-and-white)

development, washing, reversal re-exposure, color development, bleaching, fixing, washing and/or stabilizing. Another useful process has the same steps, but stabilizing is carried out between color development and bleaching. Such conventional steps are described, for example, in U.S. Pat. No. 4,921,779 (Cullinan et al.), U.S. Pat. No. 4,975,356 (Cullinan et al.), U.S. Pat. No. 5,037,725 (Cullinan et al.), U.S. Pat. No. 5,523,195 (Darmon et al.), and U.S. Pat. No. 5,552,264 (Cullinan et al.) for the processing of color reversal films (using the conventional Process E-6). Other details are provided in *Research Disclosure,* publication 38957 (noted above), and references noted therein.

Color reversal films used in the practice of this invention are comprised of a support having thereon a plurality of photosensitive silver halide emulsion layers that can contain any conventional silver halide (or mixture thereof). Such films generally have silver halide emulsions having at least 1 mol % iodide based on total silver.

Useful supports are well known and include polyester films, polycarbonate films and cellulose acetate films. The silver halide layers include conventional binder materials, and other conventional addenda. Some specific commercially available color reversal photographic films that can be processed using this invention include EKTACHROME and KODACHROME Color Reversal Films (Eastman Kodak Company), FUJICROME Color Reversal Films (Fuji Photo Film Co., Ltd.), AGFACHROME Color Reversal Films (AGFA), and KONICACHROME Color Reversal Films (Konica).

Photographic reversal compositions are also known in the art, including for example U.S. Pat. No. 3,617,282 (Bard et al.) and U.S. Pat. No. 5,736,302 (Buongiome et al.), both incorporated herein by reference.

The color development is generally accomplished with a color developing composition containing the chemical components conventionally used for that purpose, including color developing agents, buffering agents, metal ion sequestering agents, optical brighteners, halides, antioxidants, sulfites and other compounds readily apparent to one skilled in the art. Examples and amounts of such components are well known in the art, including for example U.S. Pat. No. 5,037,725 (noted above) and U.S. Pat. No. 5,552,264 (noted above).

Another useful composition for color reversal processing is a composition that provides dye image stabilization. If in liquid form, this composition generally includes a dye stabilization compound (such as an alkali metal formaldehyde bisulfite, hexamethylenetetramine and various formaldehyde releasing compounds), buffering agents, bleach-accelerating compounds, secondary amines, preservatives, and metal sequestering agents. All of these compounds are well known in the art, including U.S. Pat. No. 4,839,262 (Schwartz), U.S. Pat. No. 4,921,779 (noted above), U.S. Pat. No. 5,037,725 (noted above), U.S. Pat. No. 5,523,195 (noted above) and U.S. Pat. No. 5,552,264 (noted above).

A final rinse composition generally has a pH of from about 5 to about 9 (in liquid form), and can include one or more surfactants (anionic, nonionic or both), biocides and buffering agents as is well known in the art. See for example, U.S. Pat. No. 3,545,970 (Giorgianni et al.), U.S. Pat. No. 5,534,396 (McGuckin et al.), U.S. Pat. No. 5,645,980 (McGuckin et al.), U.S. Pat. No. 5,667,948 (McGuckin et al.), and U.S. Pat. No. 5,716,765 (McGuckin et al.).

Advantageously, the black-and-white photographic developing composition of this invention can be included as part of a processing kit that includes one or more additional photographic processing compositions needed for providing the desired images. For example, additional photoprocessing compositions include photographic fixing compositions for processing black-and-white photographic materials, or photographic color developing, bleaching, fixing and reversal compositions for processing color reversal photographic materials. The kit may also include washing solutions, instructions, fluid or composition metering devices, or any other conventional components of a photographic processing kit. All of the components can be suitably packaged in dry or liquid form in glass or plastic bottles, fluid-impermeable packets or vials.

The following examples are provided for illustrative purposes and are not to be considered limiting in any manner.

EXAMPLES 1 & 2

Single-Part Developing Compositions

Black-and-white concentrated photographic developing compositions of this invention and a Control composition were prepared by mixing the components of TABLE III below.

TABLE III

| COMPONENT | Control | Example 1 | Example 2 |
|---|---|---|---|
| Water | 1000 g | 600 g | 700 g |
| Diethylene glycol | 0 | 400 g | 300 g |
| Sodium erythorbate | 100 g | 50 g | 50 g |
| HMMP** | 3 g | 1.5 g | 1.5 g |
| Versenex 80 (40% solution)* | 37.5 g | 18.75 g | 18.75 g |
| pH | 10 | 10 | 10 |

*Versenex 80 contains pentasodium diethylenetriaminepentaacetic acid
**4-hydroxymethyl-4-methyl-1-phenyl-3-pyrazolidone The three compositions were evaluated for stability, precipitation formation, discoloration, and solvent evaporation after 7 weeks storage at room temperature, about 20° C. and ambient humidity. The results are shown in TABLE IV below.

TABLE IV

| Composition | Stability-loss in sodium erythorbate (%)/HMMP (%) | Change in pH measured | Evaporation | Discoloration/precipitation |
|---|---|---|---|---|
| Control | 40%/10% | 4.0 | 35% | Orange/many white particles |
| Example 1 | 10%/0% | 2.0 | 10% | Yellowed/some particles |
| Example 2 | 14%/0% | 2.5 | 15% | Yellowed/few particles |

These results show that the essential components of developer can be formulated into a concentrated solution that is quite stable against oxidation. Stability against pH change is improved over the control aqueous developer These results also show that evaporation is significantly lower than a control aqueous developer. Discoloration and particle formation is also improved.

EXAMPLE 3

Two-part Developing Composition Kit

A two-part black-and-white developing composition kit was prepared using the components shown in TABLE V below.

TABLE V

| COMPONENT | Part A | Part B |
|---|---|---|
| Water | 800 g | ~250 g |
| Diethylene glycol | 200 g | 0 |
| Ascorbic acid | 81 g | 0 |
| HMMP | 3 g | 0 |
| Versenex 80 (40% solution) | 37.5 g | 0 |
| Sodium sulfite | 2 g | 0 |
| Potassium sulfite (45%) | 0 | 900 g |
| Borax (5 mol) | 0 | 30 g |
| pH | 4.9 | 10.23 |

The noted Part A composition was evaluated for stability, solvent evaporation, precipitate formation and discoloration as described in Examples 1 and 2. There was a slight pH loss of 0.1 unit. There was no loss in HMMP and only 6% loss in ascorbic acid observed. There was very slight discoloration to pale yellow and no formation of precipitates. Solvent evaporation was only 5%.

EXAMPLE 4

Two-part Developing Composition Kit

Another two-part black-and-white concentrated developing composition kit was prepared using the components shown in TABLE VI below.

TABLE VI

| COMPONENT | Part A | Part B |
|---|---|---|
| Water | 600 g | ~250 g |
| Diethylene glycol | 400 g | 0 |
| Ascorbic acid | 81 g | 0 |
| HMMP | 3 g | 0 |
| Versenex 80 (40% solution) | 37.5 g | 0 |
| Sodium sulfite | 2 g | 0 |
| Potassium sulfite (45%) | 0 | 900 g |
| Borax (5 mol) | 0 | 30 g |
| pH | 45 | 10.23 |

The noted Part A composition was evaluated for stability for solvent evaporation, precipitate formation and discoloration as described in Examples 1 and 2. There was no change in solution pH. There was no loss in HMMP and only 7% loss in ascorbic acid observed. There was slight discoloration to pale yellow and no formation of precipitates. Solvent evaporation was only 15%.

EXAMPLE 5

Processing of Black-and-White Photographic Materials

The black-and-white developing composition of Example 3 above was used to process imagewise exposed samples of commercially available paper, without incorporated developing agent, Ilford Multigrade IV RC Deluxe in the following manner.

The paper samples were developed using 1 liter of developer made from Example 3 developing composition. (100 ml/1 Part A plus 100 ml/1 Part B) for 3 minutes at 22° C., fixed using 400 ml of commercially available KODAK Rapid Fixer, (diluted 1:1) for 2 minutes at ambient temperature, washed with tap water for 5 minutes and dried in the air at room temperature. The desired black-and-white images were obtained in all of the samples.

The invention has been described in detail with particular reference to certain preferred embodiments thereof, but it will be understood that variations and modifications can be effected within the spirit and scope of the invention.

We claim:

1. A two-part aqueous black-and-white developing composition kit comprising:

a) an aqueous first solution having a pH of from about 3 to about 6 that is essentially free of dihydroxybenzene compounds and comprises:
   at least 0.05 mol/l of an ascorbic acid developing agent,
   a water-miscible hydroxy-containing organic solvent having a molecular weight of from about 50 to about 200, the weight ratio of said organic solvent to water being from about 0.05:1 to about 8:1, and
   at least 0.0005 mol/l of a 3-pyrazolidone co-developing agent, and b) a second aqueous solution having a pH of from about 8 to about 12 and comprising a borate buffer and at least 0.05 mol/l of sulfite ions.

2. The developing composition kit of claim 1 wherein the weight ratio of said organic solvent to water is from about 0.1:1 to about 1:1 in said aqueous first solution.

3. The developing composition kit of claim 1 wherein said organic solvent is an alcohol or glycol.

4. The developing composition kit of claim 3 wherein said organic solvent is ethylene glycol, diethylene glycol, propylene glycol, ethanol, benzyl alcohol, triethylene glycol, or polyethylene glycol.

5. The developing composition kit of claim 1 wherein said first aqueous solution has a pH of from about 4.5 to about 5.5 and is essentially free of dihydroxybenzene compounds and comprises:

a) from about 0.2 to about 1 mol/l of an ascorbic acid developing agent, b) a water-miscible hydroxy-containing organic solvent having a molecular weight of from about 50 to about 200, the weight ratio of said organic solvent to water being from about 0.1:1 to about 1:1, c) from about 0.001 to about 0.2 mol/l of sulfite ions, d) from about 0.0005 to about 0.02 mol/l of a 3-pyrazolidone co-developing agent, and e) up to 0.2 mol/l of a buffer, and said second aqueous solution has a pH of from about 9 to about 11 and comprises from about 0.1 to about 0.4 mol/l of sulfite ions, and from about 0.1 to about 0.4 mol/l of a buffer.

6. The developing composition kit of claim 5 wherein said buffer in said second aqueous solution is a borate, and said organic solvent is ethylene glycol or diethylene glycol.

7. The developing composition kit of claim 1 wherein said organic solvent has a molecular weight of from about 100 to about 200.

8. The developing composition kit of claim 1 wherein said organic solvent has a molecular weight of from about 50 to about 150.

* * * * *